US012714235B2

(12) United States Patent
Lewis

(10) Patent No.: US 12,714,235 B2
(45) Date of Patent: Aug. 25, 2026

(54) COVER FOR A BODY SUPPORT CUSHION

(71) Applicant: TEMPUR WORLD, LLC, Lexington, KY (US)

(72) Inventor: Jessica Lewis, Lexington, KY (US)

(73) Assignee: TEMPUR WORLD, LLC, Lexington, KY (US)

( * ) Notice: Subject to any disclaimer, the term of this patent is extended or adjusted under 35 U.S.C. 154(b) by 127 days.

(21) Appl. No.: 18/547,429

(22) PCT Filed: Feb. 23, 2022

(86) PCT No.: PCT/US2022/017463

§ 371 (c)(1),
(2) Date: Aug. 22, 2023

(87) PCT Pub. No.: WO2022/182717

PCT Pub. Date: Sep. 1, 2022

(65) Prior Publication Data

US 2024/0130538 A1 Apr. 25, 2024
US 2024/0225298 A9 Jul. 11, 2024

Related U.S. Application Data

(60) Provisional application No. 63/152,491, filed on Feb. 23, 2021.

(51) Int. Cl.
*A47C 27/00* (2006.01)

(52) U.S. Cl.
CPC ..... *A47C 27/002* (2013.01)

(58) Field of Classification Search
CPC ..... A47C 27/002; A47C 27/148; A47C 27/15; A47C 31/105; A47G 9/0253
See application file for complete search history.

(56) References Cited

U.S. PATENT DOCUMENTS 5,966,759 A * 10/1999 Sanders ..... A47C 27/007 5/699
6,886,197 B1 * 5/2005 Madigan ..... A47G 9/02 5/493

(Continued)

FOREIGN PATENT DOCUMENTS

CN 202589004 U 12/2012
CN 205903084 U 1/2017

(Continued)

OTHER PUBLICATIONS

United States Patent and Trademark Office, International Search Report and Written Opinion issued in corresponding Application No. PCT/US2022/017463, mailed Jul. 5, 2022.

*Primary Examiner* — Matthew Troutman
*Assistant Examiner* — Alison N Labarge
(74) *Attorney, Agent, or Firm* — Stites & Harbison, PLLC; Terry L. Wright; James R. Hayne

(57) ABSTRACT

A cover for a body support cushion comprises an upper section for covering an upper area of a body support cushion, and a lower section for covering a lower area of the body support cushion. A primary zipper connects the upper section to the lower section. An expansion material is positioned between the upper section and the lower section and is further connected to a secondary zipper including a first coil and a second coil. The first coil and the second coil of the secondary zipper are configured to be separated to expand the expansion material or are configured to be moved together to collapse the expansion material, such that the expansion material is visible in an expanded configuration and is hidden behind the secondary zipper in a collapsed configuration. Body support cushion assemblies that make use of the covers to surround a body support cushion are further provided.

20 Claims, 13 Drawing Sheets

(56) References Cited

U.S. PATENT DOCUMENTS

| | | | | |
|---|---|---|---|---|
| 7,181,797 | B2 | 2/2007 | Chase | |
| 8,904,581 | B2 | 12/2014 | Rabbany et al. | |
| 10,104,984 | B2 | 10/2018 | Hagglund | |
| 10,413,082 | B2 | 9/2019 | Lava et al. | |
| D989,521 | S * | 6/2023 | Shan | D6/606 |
| 2005/0132498 | A1* | 6/2005 | Vrionis | A47G 9/0246 5/737 |
| 2012/0117728 | A1* | 5/2012 | O'Neill | A47C 31/007 5/499 |
| 2012/0284924 | A1* | 11/2012 | Pratt | A47G 9/10 5/640 |
| 2014/0096325 | A1* | 4/2014 | Giannopoulos | A47C 27/00 5/691 |
| 2014/0373276 | A1* | 12/2014 | Fan | A47G 9/0253 5/499 |
| 2015/0182032 | A1* | 7/2015 | Jensen | G09F 3/00 5/699 |
| 2015/0187233 | A1 | 7/2015 | Jensen et al. | |
| 2015/0190002 | A1 | 7/2015 | Polenick | |
| 2016/0100697 | A1 | 4/2016 | Prochazka et al. | |
| 2016/0157625 | A1* | 6/2016 | Schneider | A47C 27/006 5/699 |
| 2016/0353907 | A1* | 12/2016 | Lava | A47C 27/002 |
| 2017/0332805 | A1* | 11/2017 | Hagglund | A47C 27/15 |
| 2018/0325291 | A1* | 11/2018 | Holbrook | A47G 9/04 |

FOREIGN PATENT DOCUMENTS

| | | | |
|---|---|---|---|
| DE | 202013104359 | U1 | 10/2013 |
| DE | 202014105557 | | 2/2015 |
| ES | 1020274 | U | 1/1993 |
| KR | 200486767 | Y1 | 7/2018 |
| WO | 2012135901 | A1 | 10/2012 |

* cited by examiner

COVER FOR A BODY SUPPORT CUSHION

RELATED APPLICATIONS

This application claims priority from U.S. Provisional Application Ser. No. 63/152,491, filed Feb. 23, 2021, the entire disclosure of which is incorporated herein by this reference.

TECHNICAL FIELD

The present invention relates to covers for a body support cushion. In particular, certain embodiments of the present invention relate to covers for a body support cushion having an expansion material positioned between an upper section and a lower section of the cover.

BACKGROUND

To protect a mattress and prevent it from becoming stained, torn, or otherwise damaged, mattresses are often surrounded by a mattress cover that completely covers the top, sides, and the bottom of the mattress. In most mattress covers, a zipper or other similar fastener is used to enclose the mattress cover on a single side or around a bottom portion of the mattress. Such mattress covers are often sufficient for protecting a mattress. However, such covers have, to date, not allowed for any customization of the underlying support cushion. For example, in a given support cushion assembly, some users may desire a firmer mattress feel while other users may desire a softer mattress feel, but covers for support cushions have so far not been capable of providing such tuning and, in turn, providing a desired, unique feel to a user resting on the underlying support cushion. Accordingly, a body support cushion cover that allows the feel of the underlying cushion to be adjusted and, consequently, provides a tunable, more desirable feel to the user of the cushion would be both highly desirable and beneficial.

SUMMARY

The present invention includes covers for a body support cushion. In particular, certain embodiments of the present invention includes covers for a body support cushion having an expansion material or pocket positioned between an upper section and a lower section of a cover, where the expansion material or pocket can be expanded or collapsed to thereby vary the firmness and feel of the underlying support cushion.

In some embodiments of the present invention, a cover for a body support cushion is provided where, in certain embodiments, the body support cushion is a mattress. The cover comprises a lower section, an upper section, and an expansion material or pocket. The expansion pocket is formed of an expansion material that extends between the upper section and lower section and allows for expansion between the two cover portions to adjust the firmness of the cover and therefore the feel of the mattress to the end user.

In some embodiments, an exemplary body support cushion cover comprises an upper section that is configured to cover an upper area of a body support cushion, a lower section that is configured to cover a lower area of the body support cushion, and a primary zipper for connecting the upper section to the lower section, where the primary zipper includes zipper teeth that extend about a peripheral edge of the upper section and zipper teeth that extend about the peripheral edge of the lower section. An expansion material is positioned and extends between the upper section and the lower section, and a secondary zipper is further included and has a first coil and a second coil. The secondary zipper and, in particular, the first coil and the second coil of the secondary zipper are configured to be separated to expand the expansion material or are configured to be moved together to collapse the expansion material, such that the expansion material is visible in an expanded configuration and such that the expansion material is hidden behind the secondary zipper in a collapsed configuration.

In some embodiments, one or more additional features are also incorporated into or otherwise used with an exemplary cover for a body support cushion. In some embodiments, upon positioning the cover on a support cushion, the primary zipper and the secondary zipper are at a constant elevation about the cover. In other embodiments, the primary zipper and the secondary zipper vary in elevation about the cover. In some further embodiments, the primary zipper and the secondary zipper are at a higher elevation along a head end and a feet end of the cover and a lower elevation along sides of the cover.

Moreover, in some embodiments, the expansion material used in accordance with the present invention is a different color than at least one of the upper section and the lower section, such as, in some embodiments, where the expansion material is a different color than both of the upper section and the lower section. Similarly, in some embodiments, the expansion material is of a different texture than the upper and/or lower sections.

In some embodiments of the mattress cover, an amount of tension in the cover is increased upon closing the secondary zipper, while an amount of tension in the cover is, conversely, reduced upon opening the secondary zipper. In some embodiments, the secondary zipper can be positioned on either the upper or the lower section of an exemplary cover. In some embodiments, the secondary zipper is hidden behind the primary zipper when the primary zipper is closed.

Further provided, in some embodiments, is a body support cushion assembly that makes use of an exemplary cover of the present invention. In some embodiments, a body support cushion assembly comprises a body support cushion, such as a mattress, having an upper surface, a lower surface, and at least one surrounding wall extending between the upper surface and the lower surface. A cover is then further included in the assembly and includes a top section disposed over the upper surface of the body support cushion, and a lower section disposed about the bottom surface of the body support cushion. At least one primary zipper is also included and connects the top section and the lower section, with an expansion material further positioned between the top section and the bottom section of the cover. A secondary zipper connected or otherwise associated with the expansion material is then configured to open or close the expansion material and vary the firmness of the cover.

In some embodiments of an exemplary body support cushion assembly, the expansion material is connected to the bottom section or the upper section. The body support cushion assembly, in certain embodiments, can further comprise an inner panel disposed between the top section and the upper surface of the body support cushion, where, in some embodiments, the expansion material is connected to the inner panel.

In some embodiments of the body support cushion assemblies described herein, the body support cushion assembly is in the form of a pillow assembly comprised of a cushion having an upper surface, a lower surface, and at least one joining wall extending between the upper and lower surfaces. A cover then surrounds the pillow, with the cover having an upper surface, a lower surface, and a gusset extending between the upper and lower surfaces. In the exemplary pillow assembly, an expansion material is disposed in the gusset, and an expansion zipper is connected to the expansion material such that the expansion zipper is configured to be separated and expand the expansion material or is configured to be moved together (i.e., closed or zipped) to collapse the expansion material.

Further features and advantages of the present invention will become evident to those of ordinary skill in the art after a study of the description, figures, and non-limiting examples in this document.

DETAILED DESCRIPTION

The present invention includes covers for a body support cushion. In particular, certain embodiments of the present invention includes covers for a body support cushion having an expansion material positioned between an upper section and a lower section of a cover, where the expansion material can be expanded or collapsed to thereby vary the firmness and feel of the underlying support cushion. As shown in FIGS. 1-12E, various embodiments of a cover for a body support cushion are provided where the cover is expandable between at least one first position and at least one second position. The first position can be fully closed and the second position can be fully opened, but various positions or configurations are also possible between the fully closed and the fully opened position. In this way, by adjusting the amount of expansion of the cover, the firmness of the cover, and therefore the firmness of body support cushion upon which the cover is applied, can be adjusted.

Figure 1:
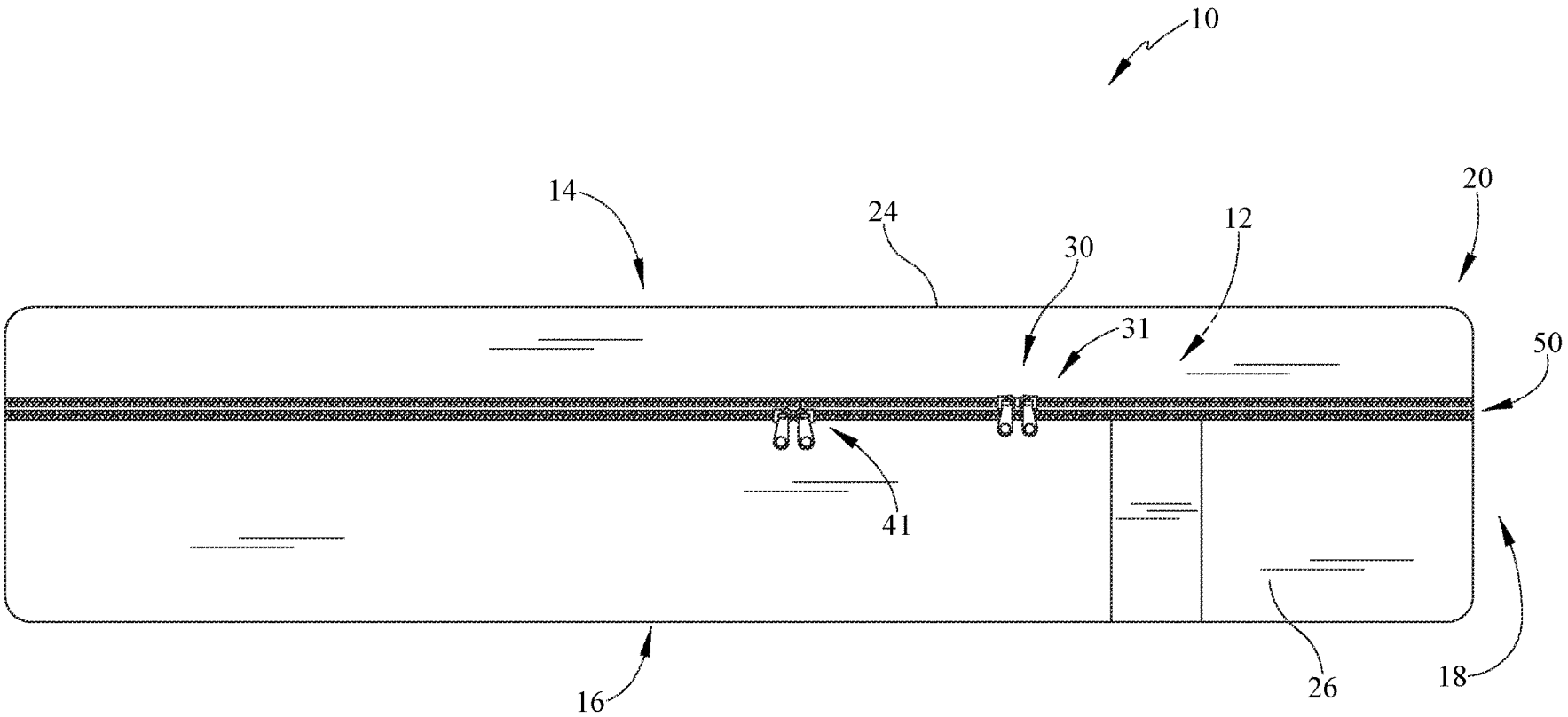
FIG. 1 is an elevation view of a body support cushion assembly made in accordance with the present invention and including a cover surrounding a body support cushion.
Figure 2:
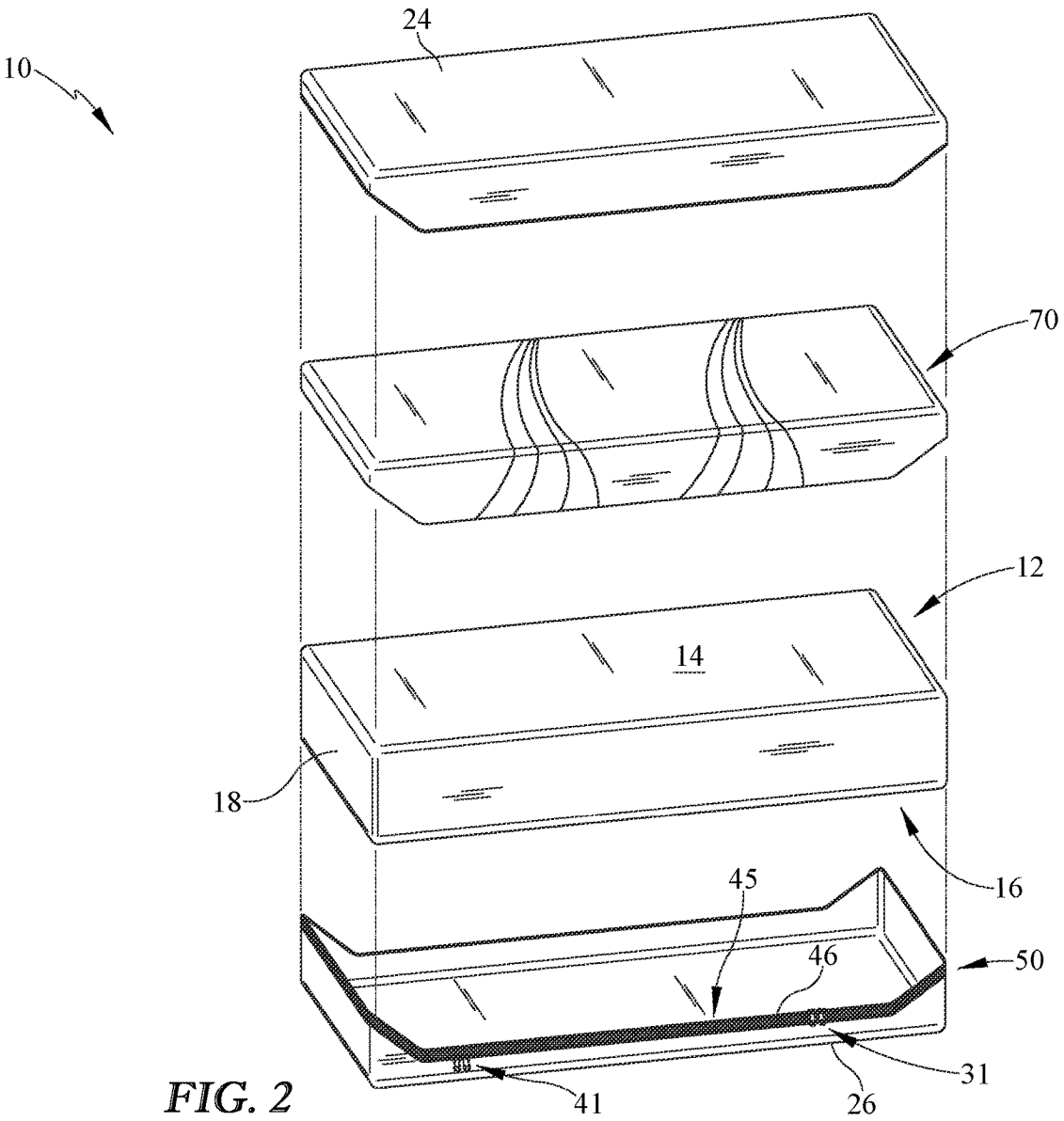
FIG. 2 is an exploded perspective view of the body support cushion assembly of FIG. 1.

Referring first to FIGS. 1-2, an elevational view of an exemplary body support cushion assembly 10 made in accordance with the present invention is shown. The body support cushion assembly 10 includes multiple components and, in particular, comprises a cushion 12 and a cover 20 defined by at least two cover portions, namely an upper and a lower cover, or cover portions 24, 26. Additionally, it should be noted that the lower cover portion 26 is also sometimes referred to as a border, and is understood to be located along the underside of a mattress form of a cushion 12.

In the exemplary body support cushion assembly 10, the body support cushion 12 is in the form or shape of a mattress, as perhaps shown best in FIG. 2, and further comprises an upper surface 14, a lower surface 16, and at least one supporting sidewall 18 extending between the upper surface 14 and the lower surface 16 of the cushion 12. As is typical with mattresses, the at least one sidewall 18 includes four sidewalls defining a rectangular shape. It is of course contemplated, however, that an exemplary body support cushion can also be in various other forms and can comprise, as non-limiting examples, various types of supports including bedding, other mattresses, and/or cushions for chairs and furniture, such as pillows. Additionally, the term "cushion" can include padding for medical devices and equipment (e.g., wheelchair seat pads, wheelchair padding, medical pads, hospital gurney pads, operating table pads, positioning pads), padding for furniture (e.g., upholstery padding, furniture cushions, furniture pads), padding for athletic equipment and devices (e.g., athletic cushions, sports and athletic padding, gymnastic mats), padding for recreational equipment and devices (e.g., camping and sleeping mats), padding for apparel (e.g., bra straps, shoulder pads, shoe linings, boot linings), padding for household goods (e.g., anti-fatigue mats, mattress pads, mattress covers, mattress "toppers," the pillow-top portion of pillow-top mattresses, pillows, and the like); padding accessories (e.g., briefcase shoulder straps, computer carrying cases, purses, gloves, and the like), pet beds, and the like. Thus, any of these types of structures, and others, may fall within the scope of the term body support cushion or cushion.

Referring still to FIGS. 1-2, and as indicated above, the body support cushion assembly 10 further comprises the cover 20 over top the cushion 12, with the cover 20 comprising an upper section 24 and a lower section 26. The upper and lower sections can, in certain embodiments, be formed as a single piece with an opening for insertion of the cushion 12, or may be partially separable or wholly separable. In the cover shown in FIGS. 1-2, however, the upper section 24 and the lower section 26 are distinct structures and are joined together by a fastener 30 in the form of a primary zipper 31 that extends along each of the at least one supporting sidewall 18. In addition to the first, or primary, zipper 31, a second, or secondary, zipper 41 is also included as described further herein. Each zipper includes first teeth, or coils, 32, 34, as perhaps shown best in FIG. 5, as well as second teeth or coils 42, 44 (FIG. 5) and a zipper pull to join or separate the corresponding teeth or coils. In FIG. 1, the first zipper 31 is shown in a closed configuration such that the upper cover 24 is connected to the lower cover 26, but in an alternate configuration, the first zipper 31 can be moved to an open position, such that the upper cover 24 is separable from the lower cover 26 either partially or completely. Of course, it is contemplated an exemplary fastener used in accordance with the present invention can also comprise various other types of closure devices including, but not limited to hook and loop fasteners, snaps, clips, or like without departing from the spirit and scope of the subject matter described herein.

Figure 3:
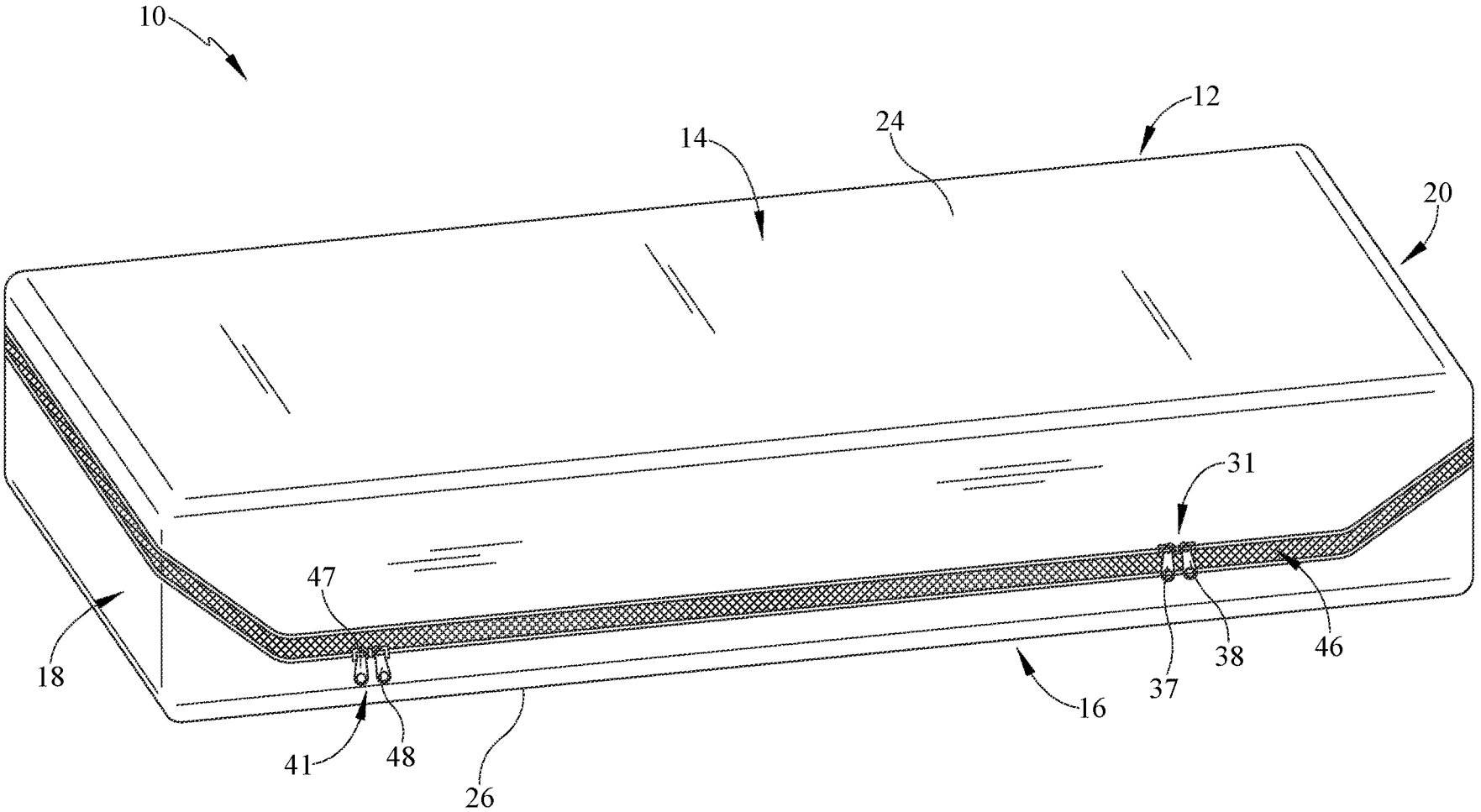
FIG. 3 is another perspective view of the body support cushion assembly of FIG. 1, and showing the expansion material of the cover in an expanded configuration.

Referring still generally to FIGS. 1-3, the secondary zipper 41 is also disposed on the cover 20 and, more specifically, in the embodiment in FIG. 1 is connected to the lower cover 26, although other configurations are possible as well. The secondary zipper 41 functions as an expansion zipper 41 and, as shown in FIG. 1, can be positioned in a closed configuration so that the cover 20 is in a tightened, firmer configuration. The expansion or secondary zipper 41, however, can then be moved from its depicted first position in which the expansion pocket 45 is closed, to a second position so that the cover expands, providing a softer feel, as shown in, for example, FIG. 3. In this second position, the expansion material 46 is revealed. When closed, the expansion material 46 forms the expansion pocket 45 and when opened, the expansion material 46 is visibly expanded again.

The body support cushion assembly 10 further comprises a seam 50 which provides a portion of the connection between the upper and lower covers 24, 26. The seam 50 also provides a connection for the expansion material 46 (FIG. 2), which, again, defines the expansion pocket 45 when in the closed position.

Referring now more particularly to FIG. 2, an exploded perspective view of the body support cushion assembly 10 is shown. The body support cushion assembly 10, as indicated above, is formed of the cushion 12 in the form of a mattress, and with the cushion 12 having the upper surface 14 and the lower surface 16 and at least one supporting sidewall 18 extending between, such that these surfaces and sidewall 14, 16, 18 provide the support surfaces/walls for the cover 20 and, more specifically, the upper and lower sections 24, 26 of the cover.

With further regard to the cushion 12, the cushion 12 may be formed of foam, gels, springs, or a combinations of these, among other materials. In some embodiments, such as that shown in FIG. 2, where the cushion 12 comprises a mattress, the mattress can be a spring mattress such as an inner spring mattress and/or a pocketed spring mattress. Further, the cushion 12, in such embodiments, can be adapted to be supported on a base or foundation (not shown), such as, for example, a frame, foundation, a box springs, or even on the floor. In this regard, in some embodiments, the body support cushion assembly can further include a planar or substantially planar base arranged parallel to an opposing surface layer. Such base or foundation may also be adjustable to move the cushion 12 between a flat position and an upright position.

The cushion 12, for example mattress, may support a user's body or a portion thereof, (e.g., head, shoulders, legs, etc.) while the user is at rest. To increase the comfort of a user, in some embodiments, the cushion 12 can also or alternatively include one or more foam layers. In the foam form, the cushion 12 may differ in firmness and comfort feel by adjusting the number, thickness and composition of the constituent foam layers. Multi-layer foam mattresses, also referred to herein as laminate mattresses, of the prior art are designed to provide adequate support, without the use of wire springs, and pressure-relieving conformity, particularly in the top layer. Typically, the first or top foam layer that is in contact with the user may be made of visco-elastic foam, i.e., foam which is both viscous in order to conform under pressure, and elastic in order to return to its uncompressed state. Visco-elastic foam is sensitive to body heat such that the material conforms to the user's body, providing a more comfortable sleep surface. Multiple layer foam mattresses come in a variety of forms as the type of material, the thickness of each layer and the density of each layer can be varied to provide a mattress with different support characteristics.

Foams have numerous characteristics, including density and firmness, which contribute to the "feel" of the mattress. Density refers to the weight per unit volume amount of gas-containing cells within a foam matrix. Firmness refers to the rigidity or spring rate of the foam. Therefore, by varying the density and firmness of a foam, one may provide a mattress having a different "feel." Further, by combining layers of different types of foams, a multitude of different mattresses possessing a broad spectrum of "feel" may be produced.

Solid foams, included closed cell and open cell (reticulated) structures, provide lightweight cellular engineering materials for weight bearing and distribution (pressure distribution) and energy absorption. In general, open-cell-structured foams have pores that are interconnected in a network. The interstitial spaces of open-cell foams can be filled with gas, liquid, or solid material. The density of foam is determined in part by both the amount of structural material which forms the cells, such as polyurethane, polyethylene or latex, and the volume or size of the cells.

Closed-cell foams generally do not have interconnected pores, generally have relatively higher compressive strength due to the closed cell bubble structures, and are relatively denser. The closed-cell structure foams have higher dimensional stability, low moisture absorption coefficients, and higher strength compared to open-cell-structured foams. The closed cells can be filled with gases to provide improved insulation, or with other materials to alter the physical properties of the foam. All types of foam have been widely used as core material in sandwich structure composite materials.

A special class of closed-cell foams is known as syntactic foam, which contains hollow particles embedded in a matrix material. The particles can be made from several materials, including glass, ceramic, and polymers. The advantage of syntactic foams is that they have a very high strength-to-weight ratio, making them ideal materials for many applications. One particular syntactic foam uses shape memory polymer which enables the foam to take on the characteristics of shape memory resins and composite materials with hysteresis properties which enable it to be reshaped repeatedly when heated above a certain temperature and cooled.

Shape memory foams have been increasingly used in bedding products such as mattresses and pillows. A significant performance issue and problem with visco-elastic and latex foam mattresses is the concentration of heat which accumulates during use as a result of the high density and low thermal conductivity of the foam material.

Many of the foregoing foams and/or foam laminates are formed with the use of glue or adhesive or join the layers of foam individually or together in any of various combinations to form the cushion or mattress or subassemblies thereof.

The cushion 12, as indicated above, can also include springs either alone or in combination with foams or foams and gels. The coil arrangements may include coil inner-springs, pocketed coils, either of which may include coil-in-coil arrangements, or combinations of foam and spring assemblies. The springs may have a linear response or a non-linear response. Spring assemblies that make use of pocket coil springs, which are also known as wrapped coils, encased coils, encased springs, or Marshall coils, are generally recognized as providing a unique feel to a mattress when used as a part of a spring assembly because each discrete coil is capable of moving independently to support the body of a user, or a portion thereof, resting on the mattress. In particular, in pocket coil spring assemblies, each coil is wrapped in a fabric pocket and moves substantially independently of the other coils in the pocket coil spring assembly to thereby provide individualized comfort and contouring to the body of a user. Moreover, as a result of moving substantially independently from one another, the pocket coils also do not directly transfer motion from one pocket coil to another, such that the movement of one user resting on a mattress assembly using pocket coils will not disturb another user resting on the mattress assembly. In this regard, mattress assemblies constructed with pocket coil springs are generally recognized as providing a soft and luxurious feel, and may be more desirable than a traditional inner spring mattress. The coils or pocketed coils may define a two dimensional array and may comprise various diameters, pitches, or other characteristics which may be used to vary the firmness of the cushion.

The cushion 12, in some exemplary body support cushion assemblies, can also comprise embodiments which allow air flow to move through the cushion 12 and cover 20 and provide airflow to the end user. For example, air flow apertures and other flow control structures may be utilized.

Still further, other materials may be used to define the one or more layers of the body support cushion 10 including, but not limited to, a gel pad, a woven layer, a nonwoven layer, a fire-resistant layer, a non-skid layer, and combinations thereof. Further, it should be clear that since the base layer may be defined by various layers or combinations of layers, the base layer may also be defined by a topper material. Additionally, a material for the cover 20 may be used as an outermost surface material for the cushion 12. In such instance, and in accordance with these teachings, the outer cover 20 may also include a surface coating.

Referring still to FIG. 2, the cover 20 is shown removed from the cushion 12 and the upper and lower sections 24, 26 are shown separated from one another, but can be joined together and joined by the fastener 30, including the primary zipper 31. In this way, the two sections 24, 26 may be completely disconnectable from one another or may be partially disconnectable either of which, by way of the primary zipper 31. Of course, the cover 20 also can include a zipper having different configurations that extends over the upper surface, lower surface, and the head and feet ends, and can form an opening to insert the mattress cushion.

With regard to the secondary zipper 41, the secondary zipper 41 can be connected to and positioned on either of the upper section 24 or the lower cover portion 26. In the exemplary body support cushion assembly shown in FIGS. 1-3, the second expansion zipper 41 is shown on the lower cover portion 26 with an upper coil on the same seam 50 as the lower coil of the primary zipper 31.

The upper cover 24 and the lower cover 26 themselves can be comprised of the same materials or different materials, or they may be the same materials but have a differing appearance. In some embodiments, the cover portions 24, 26 are formed from a material selected from polyester, cotton, rayon, spandex, or blends of any or all, or other materials as this list is not exhaustive.

Figure 7:
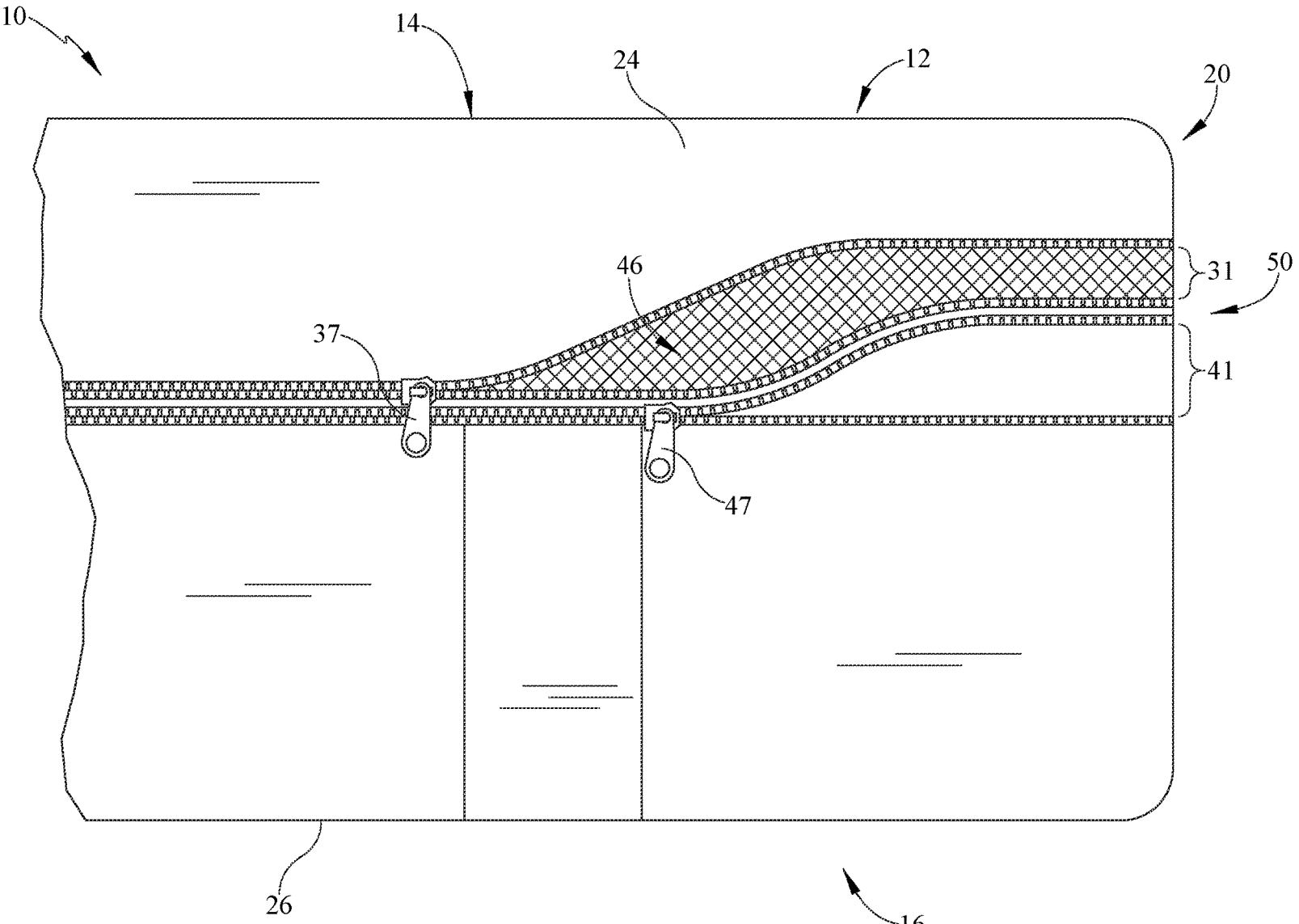
FIG. 7 is a partial elevation view of a body support cushion assembly made in accordance with another embodiment of the present invention, where the primary zipper, the expansion material, and the secondary zipper are in an alternative configuration.

Likewise, the expansion material 46 can also be formed of the same or different materials than either or both of the upper and second cover portions 24, 26. According to some embodiments, the expansion material 46 may be formed of polyester, cotton, rayon, spandex, or blends or any or all of these, or other materials as this list is not exhaustive. The expansion material 46 can have a different construction, feel, and/or appearance. It may be desirable to provide a different material, or if the same material(s) a different construction, feel, and/or appearance for the expansion material in order for a user to easily and quickly identify whether the cover 20 is in an expanded or closed configuration as the expansion material 46, when closed, defines the expansion pocket 46, but when opened expands and reveals the expansion material 46. In this regard, in the embodiment shown in FIGS. 1-3, the expansion material 46 is shown connected to the lower cover portion 26 and extending to a seam of the lower coil of the first primary zipper 31, but it is of course contemplated that the expansion material 46 can alternatively be located at the upper section 24, as described in further detail below and as shown in FIG. 7.

Also shown in FIG. 2, an optional inner panel 70 is further included in the exemplary body support cushion assembly 10. The inner panel 70 is, in this embodiment, a fabric that covers an upper surface and sides of the cushion 12. This optional feature provides some protection against spills or other fluids which may otherwise stain or damage the cushion 12. The inner panel 70 can be a simple one color fabric, multiple colors, and/or may have designs printed or embroidered therein. In some embodiments, such an inner panel 70 can be connected to the lower section 26 and extend over the cushion 12. Alternatively, the inner panel can be connected to the sidewall 18 of the cushion 12, or the inner panel 70 can be fastened in a more permanent manner or may be fastened in a disconnectable manner.

Referring now to FIG. 3, a second perspective view of the body support cushion assembly 10 is provided. In this view, the expansion zipper 41 is shown in an open position. The upper and lower cover portions 24, 26 are zipped together and the second zipper 41 is unzipped so the expansion material 46 is visible. The expansion material 46 is shown having a different appearance and form than the remainder of the upper portion 24 or the lower portion 26. The expansion material 46 adds some space, vertically as shown, between upper and lower teeth or coils 42, 44 (FIG. 5) of the expansion zipper 41. As a result, tension in the fabric of the cover 20 is reduced and the cushion feels softer to the user. The expansion zipper 41 also comprises two pulls 47, 48, which are both movable about the body support cushion 10.

Also as shown in FIG. 3, the primary zipper 31 between the upper cover 24 and the lower cover 26, as well as the secondary or expansion zipper 41, differ in elevation about the perimeter of the body support cushion assembly 10. In particular, in the embodiment shown in FIG. 3, the zippers 31, 41 are higher at the head and feet ends and drop in elevation along the long side of the cushion. This is sometimes referred to as a saddle configuration.

Figure 4:
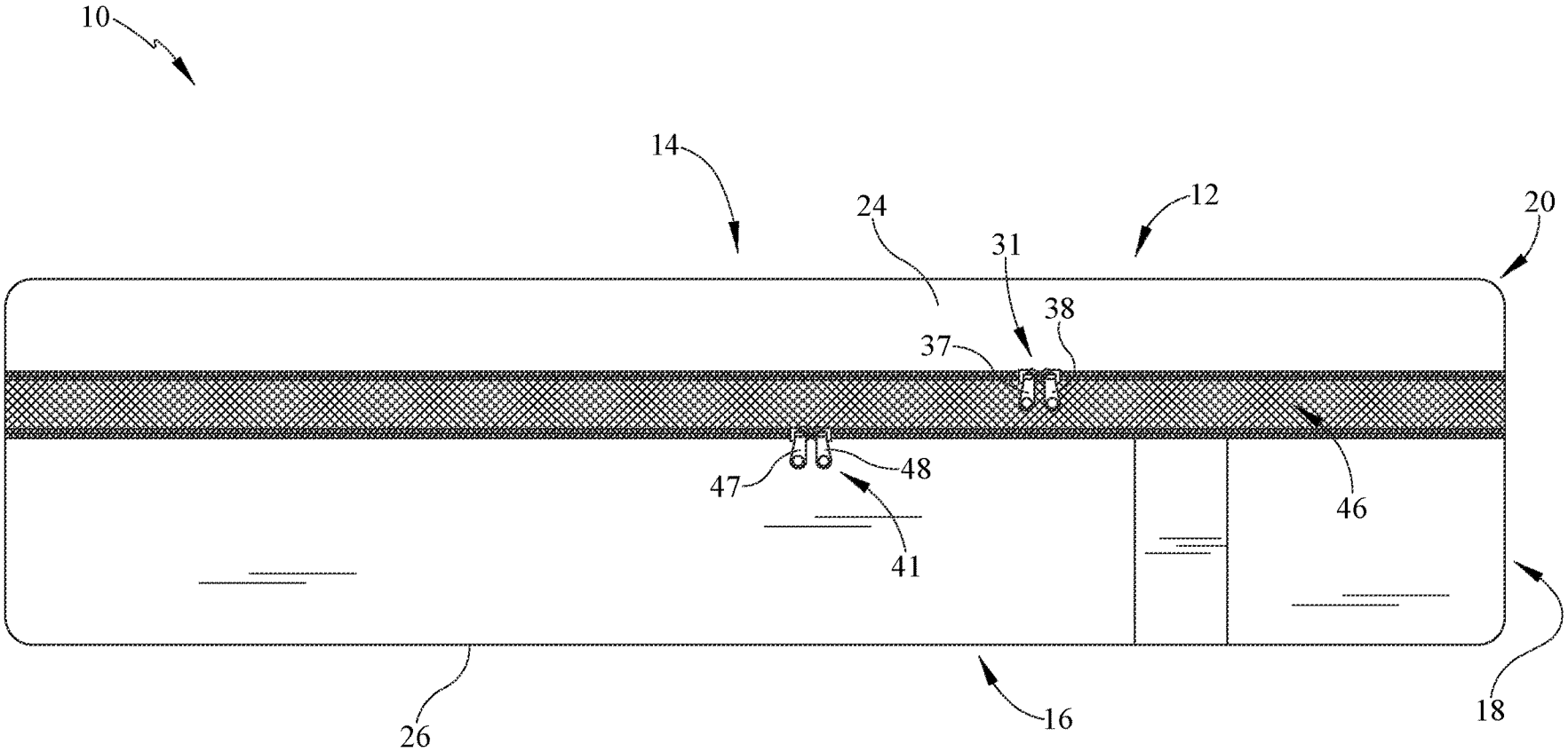
FIG. 4 is another elevation view of the body support cushion assembly of FIG. 1, and also showing the expansion material of the cover in an expanded configuration.

Referring now to FIG. 4, an end view of the body support cushion assembly 10 is depicted. The end view shows the separation of the secondary or expansion zipper 41 so that the expansion material 46 is shown. The expansion zipper 41 and the primary zipper 31 between the upper and lower cover portions 24, 26 extend at a constant elevation along this side of the cover 20. Additionally, the material 46 is shown to be of differing color so as to contrast. This provides a distinction upon viewing by the user so as to indicate that the expansion material 46 is utilized to modulate the feel of the mattress. Of course, when the expansion material 46 is not deployed and visible (i.e., when the expansion material 46 forms the pocket 45 behind the secondary zipper 41), the user understands that the expansion material 46 is not deployed, and the body support cushion 12 will have a firmer feel.

Figure 5:
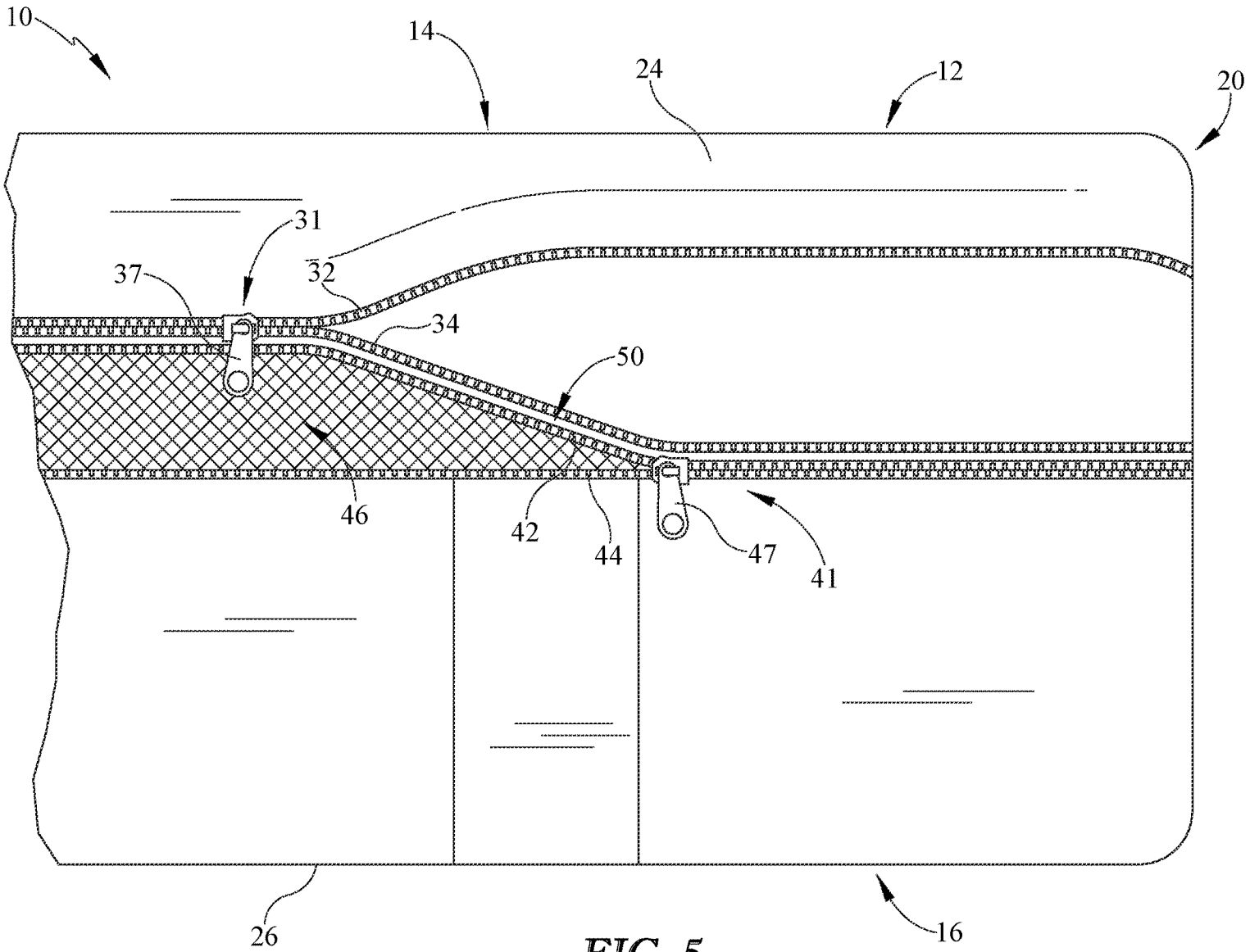
FIG. 5 is a partial elevation view of the body support cushion assembly of FIG. 1, and showing a detailed view of the primary and secondary zippers included in the assembly.

With reference now to FIG. 5, a detail view of one area of the body support cushion assembly 10 is provided. In this embodiment, the arrangement of the two zippers 31, 41 is one in which each zipper 31, 41 includes two coils and two pulls. The first zipper 31 is shown in FIG. 5 with the upper and lower coils 32, 34. A middle joining seam 50 is further shown and comprises the lower coil 34 of the first zipper 31 along an upper edge of the middle seam 50. The lower edge of the middle seam 50 comprises the upper coils 42 of the second zipper 41, which closes or opens the expansion material 46. The lower cover 26 provides lower coil or teeth 44 which engage the coils 42 of the middle seam 50. In this arrangement, the first or upper zipper 31 connects the upper cover 24 to the lower cover 26 and the lower zipper 41 opens and closes the expansion material 46, which, in turn may also allow for space to add additional material, such as a foam slab between the zippers to allow for greater end-user variation. For example, such additional foam could be between about 3 inches and about 10 inches.

Further, with the arrangement shown in FIG. 5, the upper pull 37 of the two pulls 37, 47 joins the upper coil 32 and the lower coil 34 and thus connects the upper and lower cover portions 24, 26. From the depicted position, the upper pull 37 can be moved to the right to join the upper and lower cover positions 24, 26. The lower 47 of the two pulls 47, 48 then opens or closes the expansion material 46 and, by sliding the lower pull 47 to the left, the expansion material 46 changes from the depicted open position shown on the left side of FIG. 5 to the closed position shown on the right side of FIG. 5. In this way, for example, by sliding the lower pull 47 along the coils of the second zipper 41, the upper cover 24 tightens by closing the expansion material 46, and thereby increases the firmness of the body support cushion 12 as the lower pull 47 slides partially or completely to a second pull (not shown) to firm up the cushion to a desired level.

In some alternate embodiments, it is further contemplated that a single pull may be used as doing so may be more desirable, for example, in a smaller cushion. In other embodiments, however, the use of two pulls on a particular zipper may be more user friendly and preclude the need for a user to walk the entire distance around a mattress.

Figure 6:
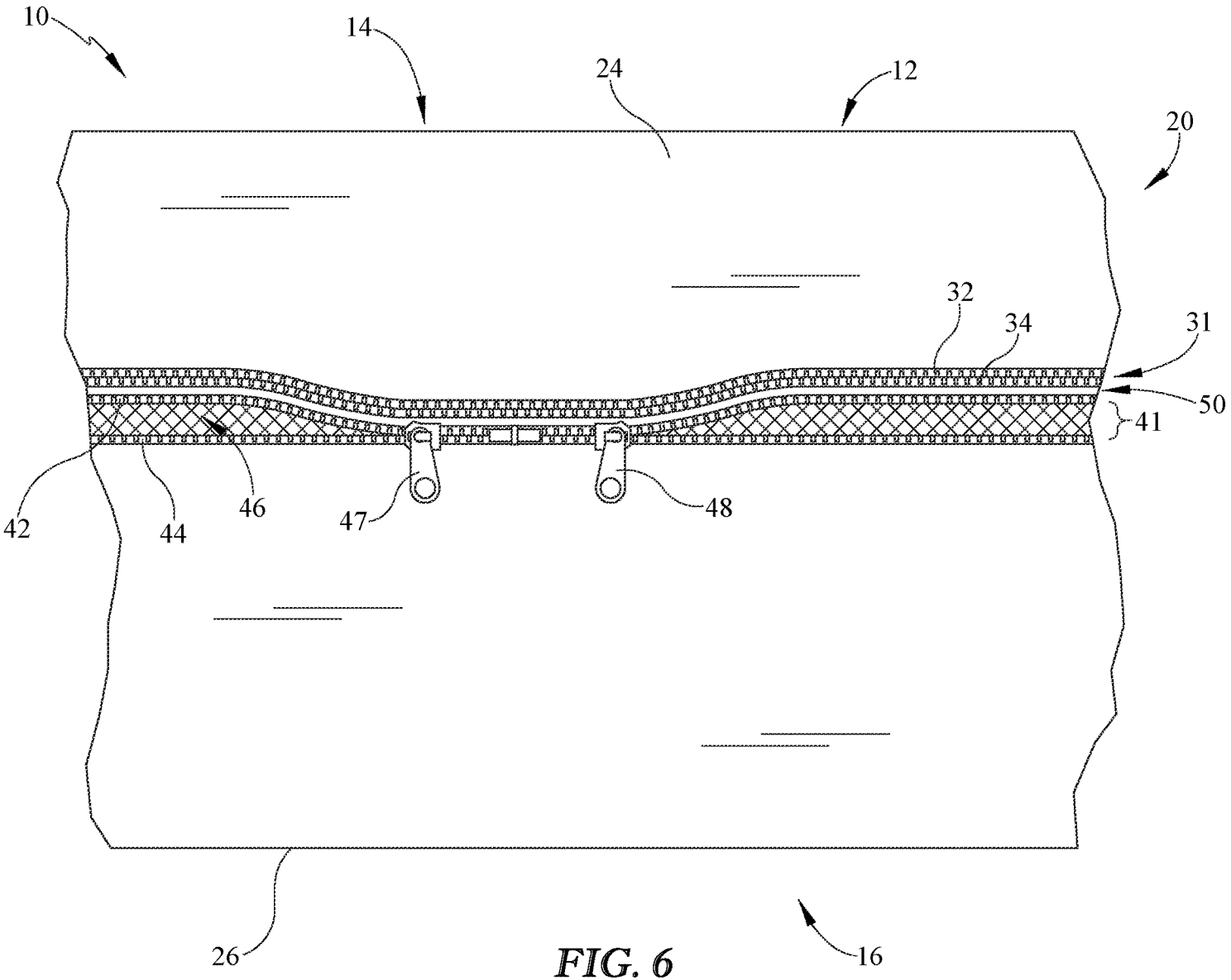
FIG. 6 is another partial elevational view of the body support cushion assembly of FIG. 1, but showing the upper and lower covers connected to one another and closed, while the expansion material is in an expanded configuration.

Referring now to FIG. 6, an alternate view of the pulls 47, 48 of the second zipper 41 are shown. The first zipper 31 is shown closed so that the upper cover 24 and the lower cover 26 are connected and the pulls 37, 38 of the first zipper 31 are not depicted. The depicted first pull 47 and the second pull 48 of the second zipper 41 are shown in close proximity with the expansion material 46 shown between the coils 42, 44 of the second zipper 41. Accordingly, the upper and lower cover 24, 26 are tightened in this area adjacent to the second zipper 41, but are spaced farther apart from one another in areas that are not proximate to the zipper pulls 47, 48.

The zippers utilized in an exemplary cover for a body support cushion assembly, such as the zippers 31, 41, can be defined by various structures. In some embodiments, each zipper can be comprised of a standard pair of zipper coils that are cut to a length and installed in place of each of the first and second zippers. In some other embodiments, however, the zipper coils may be interchangeably used. In such constructions, the zipper coils are thus designed to be interchangeable with one another, which, in certain embodiments, requires teeth or coils to have a preselected size and/or a preselected number of teeth within a certain linear length. In this way, one upper cover may be substituted with a second upper section with confidence that zipper coils that were not originally paired together will in fact function together appropriately.

As a refinement, although the embodiment shown in FIG. 5 includes the lower coil 34 of the upper zipper 31 and the upper coil 42 of the lower zipper 41 disposed on the middle, joining seam 50 material, which then extends about the cushion 12 in the area between the upper zipper pull 37 and the lower zipper pull 47 with the expansion material 46 located between the middle seam 50 and the lower cover 26, it is further contemplated that the expansion material can be incorporated into exemplary body support cushion assembly in other configurations as well. For instance, as shown in FIG. 7, the expansion material 46 can alternatively between positioned between the upper cover 24 and the middle seam 50.

Figure 8:
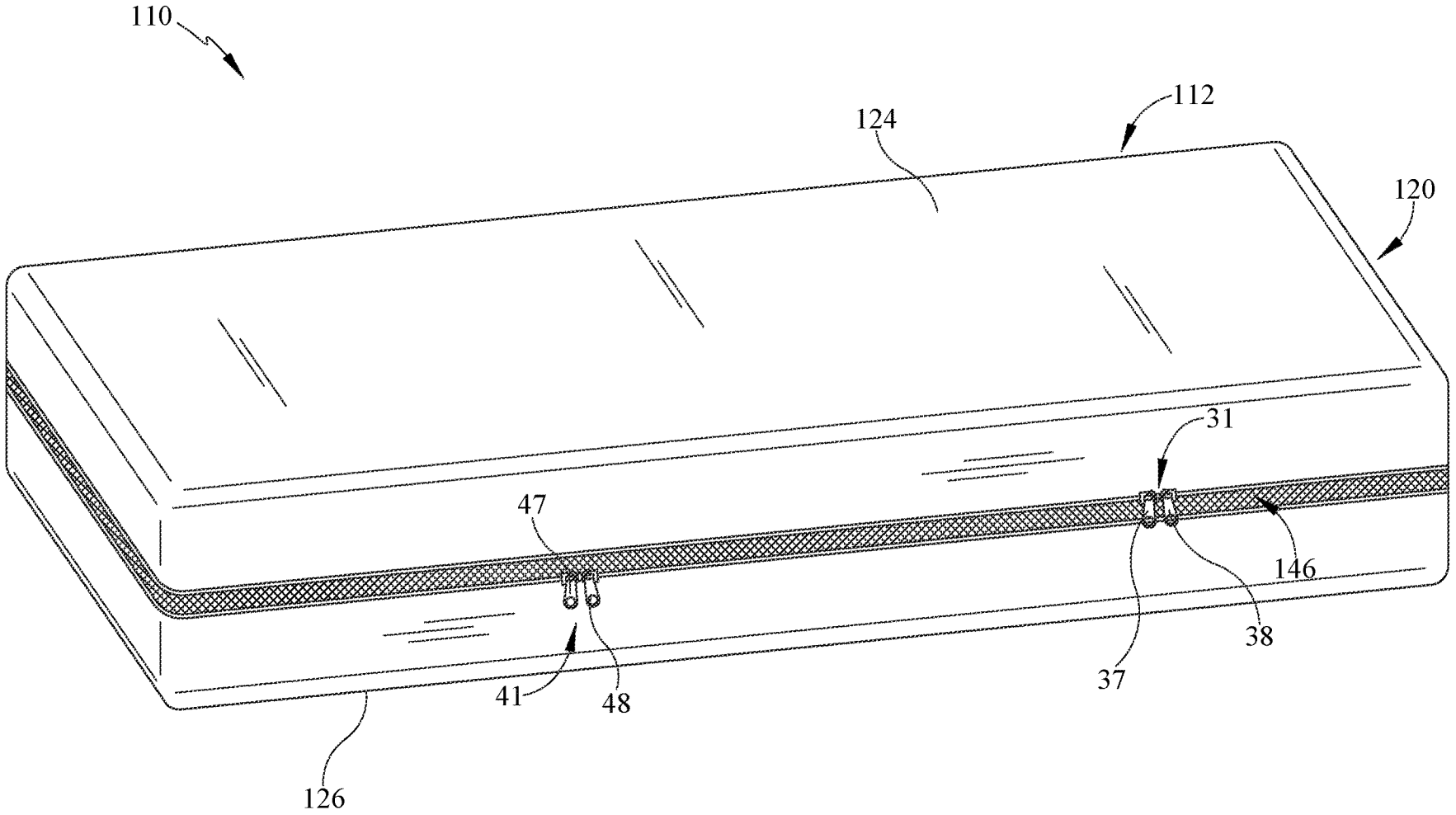
FIG. 8 is a perspective view of a body support cushion assembly made in accordance with another embodiment of the present invention.

As a further refinement, and referring now to FIG. 8, it is further contemplated that the cover and expansion material 46 may also differ in shape. As shown in FIG. 8, a body support cushion assembly 110 is provided that similarly has an upper section 124 and a lower cover portion 126 which define the cover 120, as well as a cushion 112 that is disposed within the cover 120. In the embodiment of FIG. 8, however, a different shape of the cover 120 is provided along the periphery and therefore a differing shape of the expansion material 146. In particular, unlike the previous embodiment of FIGS. 1-7, where the expansion material 46 was at different elevations about the cushion 12, the exemplary body support cushion assembly 110 of FIG. 8 includes an expansion material 146 that is disposed about the cover 120 at a constant elevation with the elevation of the zippers 31, 41 in this embodiment being constant about the periphery of the cover 20 as well. Of course, it is also contemplated that other configurations are also possible such as, in certain embodiments, the inclusion of a zipper that extends about the upper surface, the head and feet end sidewalls, and the lower surface of an exemplary cushion so that the expansion occurs along the major axis of a body support cushion.

Figure 9:
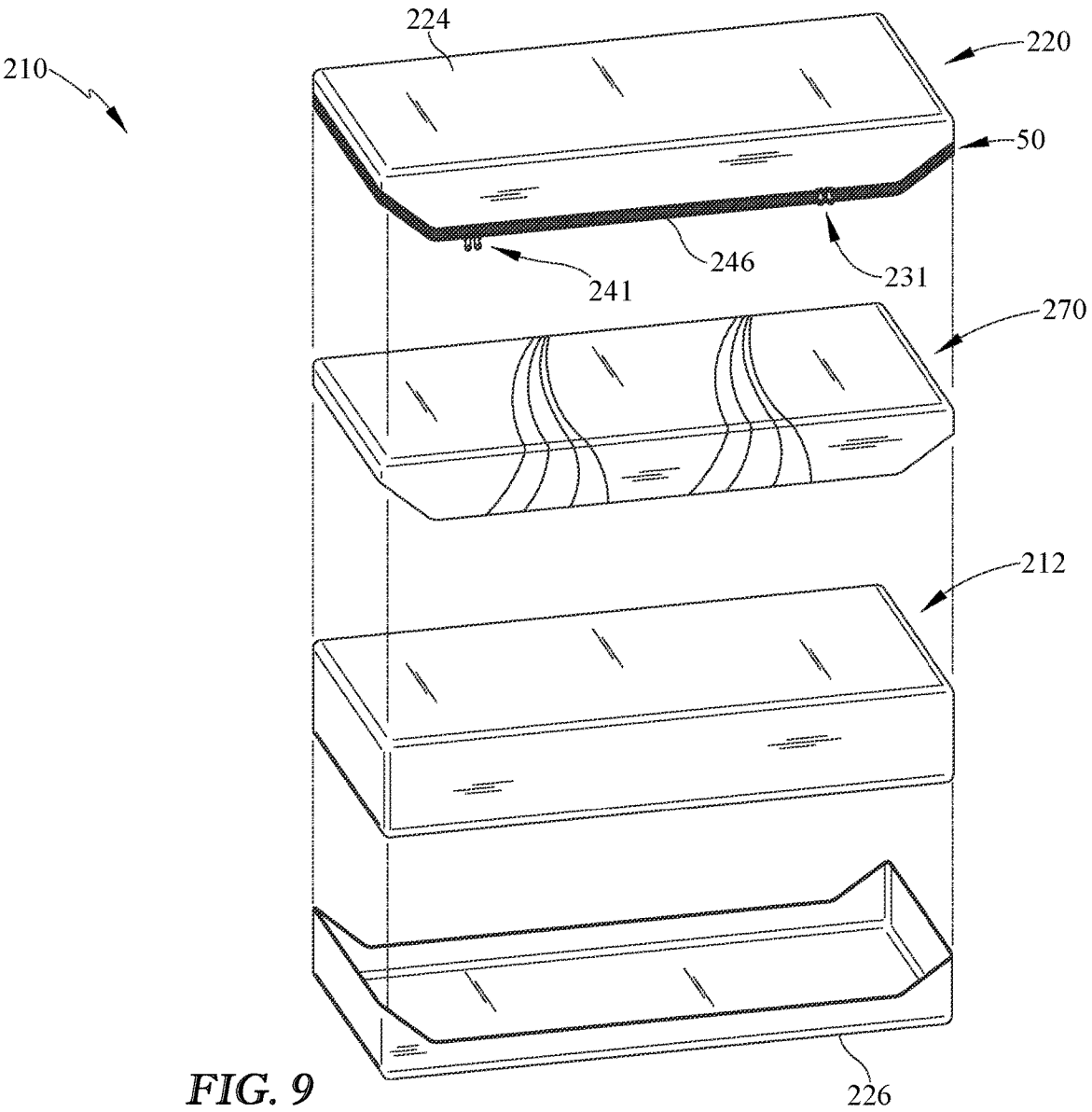
FIG. 9 is an exploded view of a body support cushion assembly made in accordance with another embodiment of the present invention, and having an inner panel and the expansion material disposed on the upper section of the cover.

With reference now to FIG. 9, a further embodiment is provided in an exploded perspective view. The embodiment provides a body support cushion 210 having a cover 220 defined by an upper section 224 and a lower section 226. The embodiment is shown having the optional inner panel 270 which may or may not be used, but is disposed between the upper cover section 224 and the cushion 212. The upper cover section 224 then comprises an expansion material 246 which defines the pocket to expand or contract. This embodiment differs from the previous embodiments which provided the expansion material connection to the lower section. In this embodiment, the expansion pocket may be opened or closed with one of the zippers 231 or 241. Alternatively, the other of the zippers 231, 241 may be used to connect the upper cover section 224 to the lower cover section 226.

Figure 10:
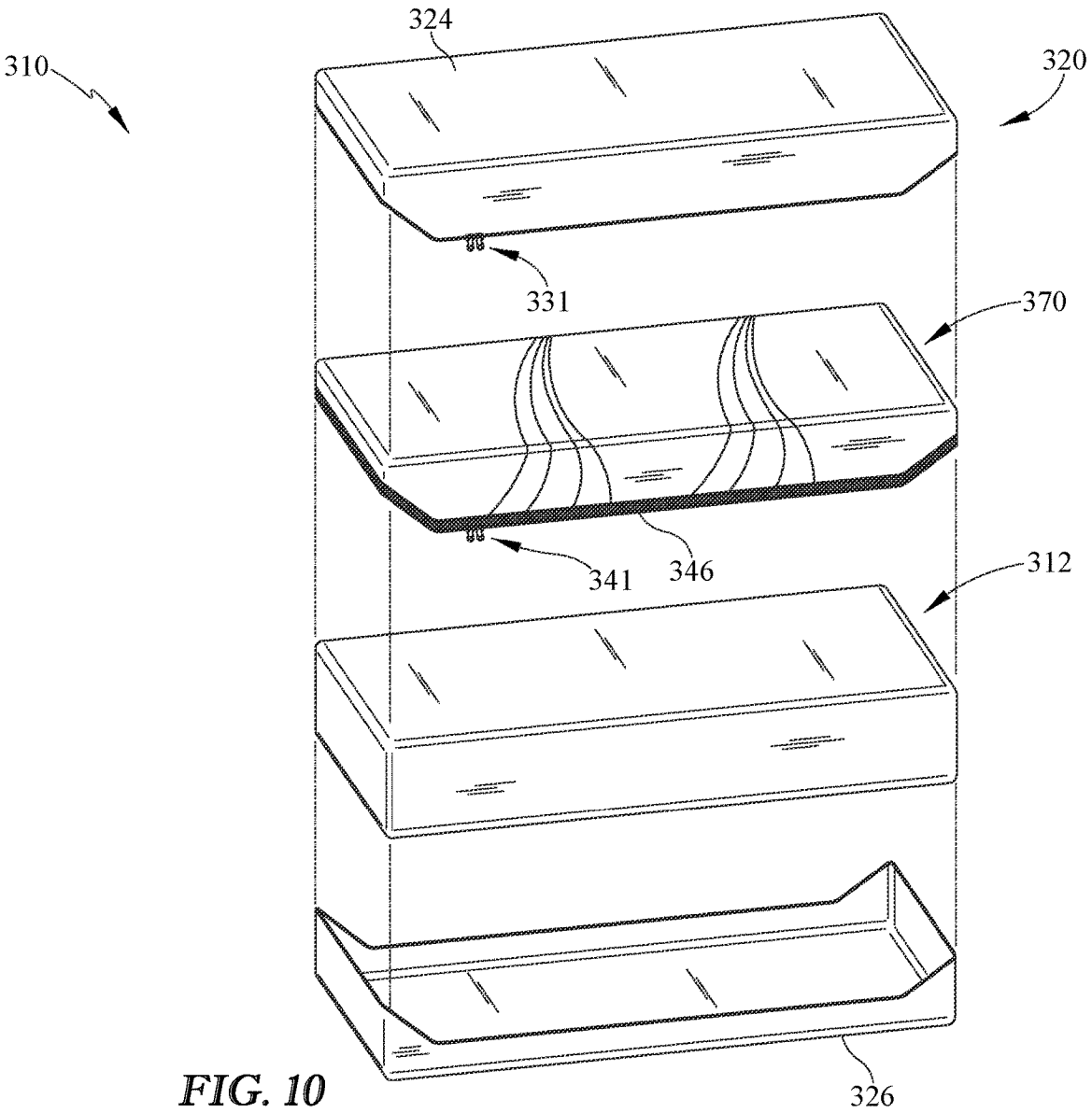
FIG. 10 is an exploded view of a body support cushion assembly made in accordance with another embodiment of the present invention, and including an inner panel with expansion material.

Referring now to FIG. 10, a further embodiment is provided. The embodiment provides a body support cushion assembly 310 with a cover 320 having the upper and lower sections 324, 326. The body support cushion assembly 310 is again shown in the embodiment of a mattress, for non-limiting example. The cushion 312 is shown disposed between the upper and lower sections 324, 326 of the cover 320. An optional inner panel 370 is disposed between the upper section 324 and the cushion 312. The inner panel 370 is shown with the expansion material 346, rather than the upper or lower cover sections 24, 26 of previous embodiments. In this embodiment, the expansion material 346 may be sewn or otherwise fastened to the lower peripheral edge of the inner panel 370 and below the zipper 331 connecting the upper section 324 and the lower section 326. The zipper 341 can thus be used to open the expansion material 346 which may be fixed at its lower edge along lower section 326. With the lower edge of the expansion material 346 fixed, the zipper 341 can control opening and closing of the expansion material 346. The upper cover section 324 can then be connected to the lower cover section 326 in the known removable fashion previously discussed.

Figure 11:
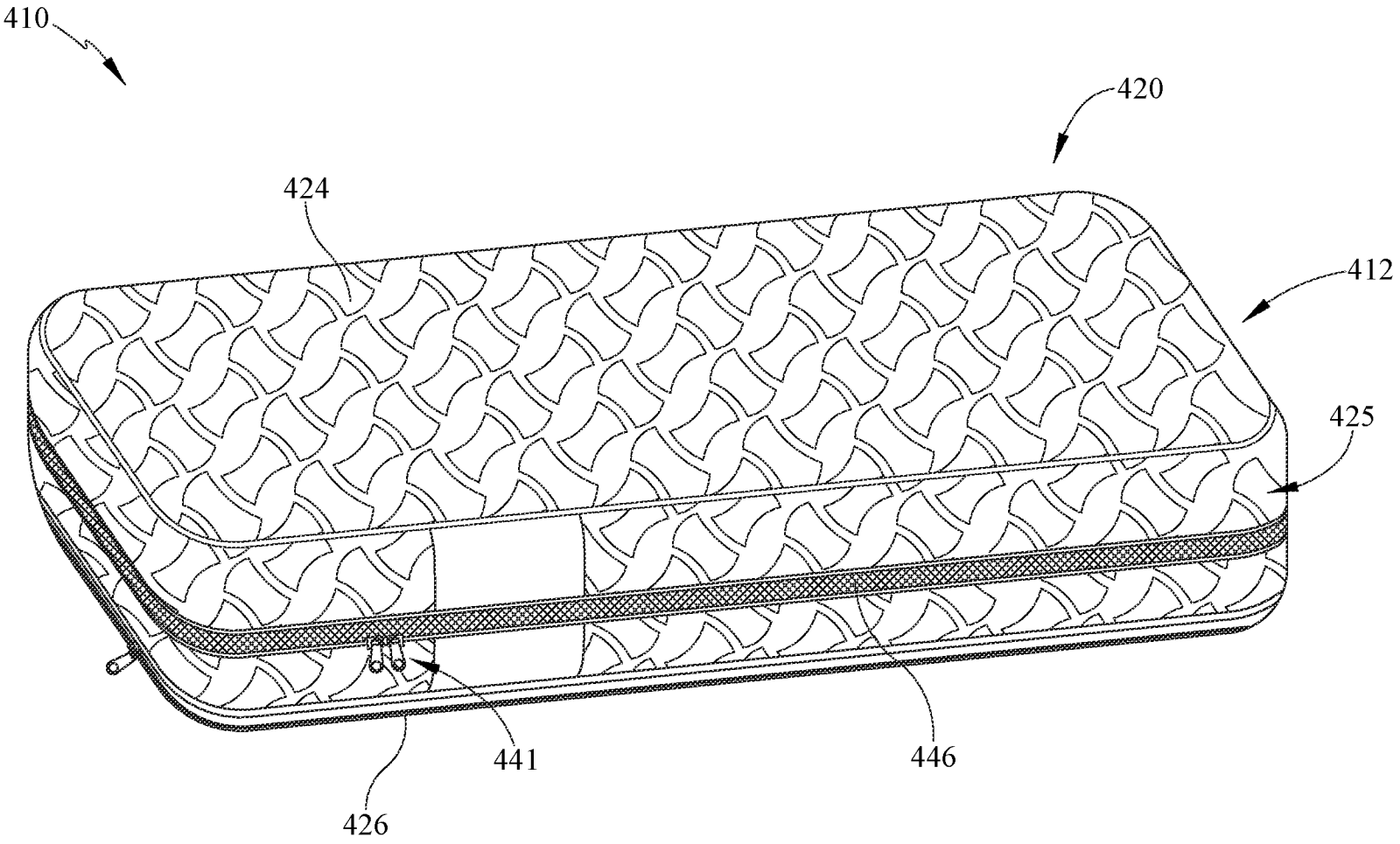
FIG. 11 is a perspective view of a pillow assembly made in accordance with the present invention, and including a cover having expansion material disposed on an inner panel.

With reference to FIG. 11, a further embodiment of a body support cushion assembly 410 is shown where the body support cushion is in the form of a pillow cushion 412. The pillow cushion 412 is disposed within the cover 420, which includes at least one opening along one or more sides of the pillow to allow access to the interior of the cover 420 where the cushion 412 is located. The cover 420 may include an upper surface 424, a lower surface 426, and a gusset 425. The gusset 425 extends between the upper and lower surfaces 424, 426. An expansion material 446 is then located along the gusset 425 at the upper edge, the lower edge, or between the edges of the gusset 425. This expansion material 446 includes a zipper 441 that allows for expansion or contraction of the material 446.

Referring now to FIGS. 12A-12E, numerous schematic diagrams are provided showing varying arrangements of materials included in an exemplary body support cushion assembly and where, for purpose of simplicity of discussion, the same numbers are used for the discussion and ease of distinguishing differences in arrangement.

Figure 12A:
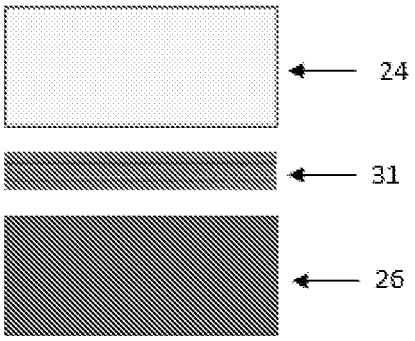
FIGS. 12A-12E are schematic diagrams showing various arrangements of the expansion material relative to a cover of the present invention.

Referring first to FIG. 12A, a schematic view of one exemplary arrangement is provided and shows a top cover 24, a bottom cover 26 and a primary zipper 31 positioned between the top cover 24 and the bottom cover 26. In this embodiment, the expansion material 46 is hidden from view by locating it behind the primary zipper 31. By opening the primary zipper 31, the secondary zipper 41 may be revealed to open and close the expansion material 46. Alternatively, the expansion material 46 may be connected at its upper and lower ends to the top section 24 and lower section 26 so that the opening and closing of the cover 20 would open and close the expansion material 46. However, in such embodiment, the top section 24 may not be removable from the bottom section 26.

Figure 12B:
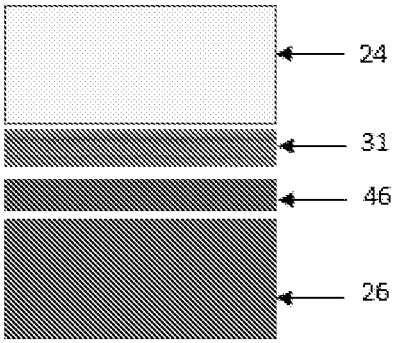

In FIG. 12B, a second view of an arrangement is provided. The expansion material 46 is connected to the border or lower section 26. The expansion material 46 is shown closed and therefore may also be considered to be the expansion zipper 41. The expansion material 46 may be three inches, as a non-limiting example. The primary zipper 31 for the cover is shown above the expansion material 46 and is connected to the top section 24. The expansion material 46 and second zipper may be disposed directly beneath the primary zipper 31 and the expansion material 46 may be contrasting to both the top section 24, the inner panel if used, and the lower section 26, in some embodiments.

Figure 12C:
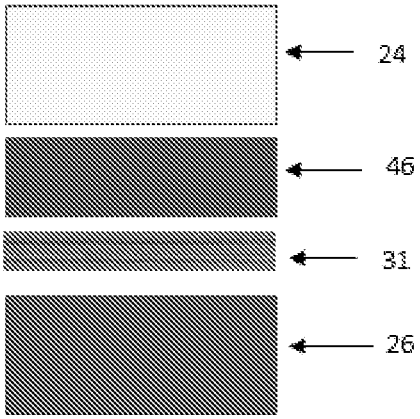

Referring to FIG. 12C, in another arrangement, the expansion material 46 and secondary or expansion zipper 41 are connected to the top section 24. In this embodiment, the expansion material 46 may optionally have a greater height, but may also be the same height as the previous embodiment. Again in this embodiment, it may be desirable to utilize a contrasting color for the expansion material.

Figure 12D:
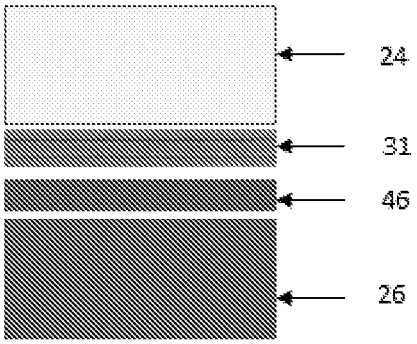

Referring now to FIG. 12D, in a further arrangement, the top section 24 is shown connected to a primary zipper 31 and the expansion material 46 is below the primary zipper 31. This is opposite to the arrangement of FIG. 12C. The height of the expansion material 46 may vary. The secondary zipper 41 and expansion material 46 may be sewn to the inner panel above or near a seam connecting the inner panel to the lower section 26.

Figure 12E:
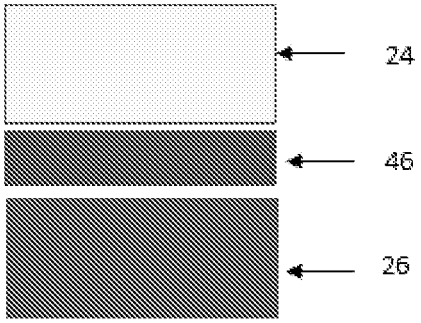

Referring to FIG. 12E, in another arrangement, the top section 24 may be used in connection with the bottom section 26, with the expansion material 46 disposed between the two. In this embodiment, there may not be an inner panel or primary zipper, only an expansion pocket. Additionally, the expansion material 46 may be contrasting relative to one or both the top section 24 and the bottom section 26.

One of ordinary skill in the art will recognize that additional embodiments are also possible without departing from the teachings of the present invention or the scope of the claims which follow. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and may be made without departing from the spirit or scope of the claimed invention.

What is claimed is:

1. A cover for a body support cushion, comprising:

an upper section including a peripheral edge and configured to cover an upper area of a body support cushion;

a lower section including a peripheral edge and configured to cover a lower area of the body support cushion;

a middle seam positioned between the upper section and the lower section;

an expansion material positioned between the upper section and the lower section, the expansion material connected to the middle seam and the expansion material connected to either the upper section or the lower section;

a primary zipper for selectively connecting the middle seam to the upper section if the expansion material is connected to the lower section or to the lower section if the expansion material is connected to the upper section;

a secondary zipper connected to the middle seam and including a second upper teeth and second lower teeth, the second upper teeth and the second lower teeth configured to be separated to expand the expansion material or configured to be moved together to collapse the expansion material, such that the expansion material is visible in an expanded configuration, and such that the expansion material is hidden behind the secondary zipper in a collapsed configuration;

wherein, when the primary zipper is in an open configuration, an opening is defined such that the body support cushion is directly accessible from said opening; and wherein, upon positioning the cover on the body support cushion, when the primary zipper is in a closed configuration, the body support cushion is completely enclosed within the cover.

2. The cover of claim 1, wherein, upon positioning the cover on the body support cushion, the primary zipper and the secondary zipper are at a constant elevation about the cover.

3. The cover of claim 1, wherein, upon positioning the cover on the body support cushion, the primary zipper and the secondary zipper vary in elevation about the cover.

4. The cover of claim 3, wherein, upon positioning the cover on the body support cushion, the primary zipper and the secondary zipper are at a higher elevation along a head end and a feet end of the cover and at a lower elevation along opposing sides of the cover.

5. The cover of claim 1, wherein the expansion material is a different color than at least one of the upper section and the lower section.

6. The cover of claim 5, wherein the expansion material is a different color than both the upper section and the lower section.

7. The cover of claim 1, wherein the expansion material has a different texture than at least one of the upper section and the lower section.

8. The cover of claim 7, wherein the expansion material has a different texture than the upper section and the lower section.

9. The cover of claim 1, wherein an amount of tension in the cover is increased upon closing the secondary zipper, and wherein an amount of tension in the cover is reduced upon opening the secondary zipper.

10. The cover of claim 1, wherein the secondary zipper is connected to the upper section or the lower section.

11. The cover of claim 1, wherein the body support cushion is a mattress.

12. A body support cushion assembly, comprising:

a body support cushion having an upper surface, a bottom surface, and at least one surrounding wall extending between the upper surface and the bottom surface; and a cover having a top section disposed over the upper surface, a bottom section disposed about the bottom surface of the body support cushion, at least one primary zipper which connects the top section and the bottom section, an expansion material positioned between the top section and the bottom section, and a secondary zipper connected to the expansion material and configured to open or close the expansion material to thereby vary the firmness of the body support cushion;

wherein, when the at least one primary zipper is in an open configuration, an opening is defined such that the body support cushion is directly accessible from said opening;

wherein, upon positioning the cover on the body support cushion, when the at least one primary zipper is in a closed configuration, the body support cushion is completely enclosed within the cover.

13. The body support cushion assembly of claim 12, wherein the expansion material is connected to the bottom section of the cover.

14. The body support cushion assembly of claim 12, wherein the expansion material is connected to the top section of the cover.

15. The body support cushion assembly of claim 12, further comprising an inner panel disposed between the top section and the upper surface of the body support cushion.

16. The body support cushion assembly of claim 15, wherein the expansion material is connected to the inner panel.

17. The cover of claim 16, wherein the secondary zipper is hidden behind the at least one primary zipper when the at least one primary zipper is closed.

18. The body support cushion assembly of claim 12, wherein the body support cushion is a mattress.

19. The body support cushion assembly of claim 18, further comprising a mattress topper positioned below the upper section of the cover.

20. A pillow assembly, comprising:

a pillow having an upper surface, a lower surface, and at least one joining wall extending between the upper and lower surfaces;

a cover having an upper surface, a lower surface, and a gusset extending between the upper and lower surfaces;

an expansion material disposed in the gusset;

an expansion zipper connected to the expansion material, the expansion zipper including second upper teeth and second lower teeth, the expansion zipper configured to be separated to expand the expansion material or configured to be moved together to collapse the expansion material; and a primary zipper including first upper teeth and first lower teeth, the primary zipper connected to the upper surface of the cover and the lower surface of the cover, the primary zipper configured to be separated to define an opening for insertion of the pillow into the cover.

* * * * *